United States Patent [19]

Ide et al.

[11] Patent Number: 4,983,444

[45] Date of Patent: Jan. 8, 1991

[54] THERMOSENSITIVE IMAGE TRANSFER RECORDING MATERIAL

[75] Inventors: Youji Ide, Mishima; Tetsuji Kunitake, Numazu, both of Japan

[73] Assignee: Ricoh Company, Ltd., Tokyo, Japan

[21] Appl. No.: 472,432

[22] Filed: Feb. 1, 1990

Related U.S. Application Data

[63] Continuation-in-part of Ser. No. 235,521, Aug. 24, 1988, abandoned.

[30] Foreign Application Priority Data

Aug. 31, 1987 [JP] Japan ..... 62-215123

[51] Int. Cl.[5] ..... B41M 5/26

[52] U.S. Cl. ..... 428/195; 428/201; 428/203; 428/205; 428/207; 428/211; 428/484; 428/488.1; 428/488.4; 428/537.5; 428/913; 428/914

[58] Field of Search ..... 428/195, 207, 211, 484, 428/488.1, 488.4, 913, 914, 201, 203, 205, 537.5

[56] References Cited

U.S. PATENT DOCUMENTS 4,720,480 1/1988 Ito et al. ..... 428/195

*Primary Examiner*—Pamela R. Schwartz

*Attorney, Agent, or Firm*—Oblon, Spivak, McClelland, Maier & Neustadt

[57] ABSTRACT

A thermosensitive image transfer recording material is disclosed, which comprises a ribbon-shaped substrate; a plurality of thermosensitive image transfer layer sections formed on the substrate, each thermosensitive image transfer layer section having a different color, which are sequentially disposed adjacent to each other in the longitudinal direction of the substrate; and a plurality of marker layer sections for optically detecting the color of any of the thermosensitive image transfer layer sections adjacent to the marker layer section, each of which marker layer sections is disposed in the regions between the thermosensitive image transfer layer sections in such a configuration that at least part of the surface of each marker section is covered by at least one of the two thermosensitive image transfer layer sections adjacent to the marker layer section, with the entire surface of the substrate being completely covered by the image transfer layer sections and the marker layer sections.

17 Claims, 1 Drawing Sheet

THERMOSENSITIVE IMAGE TRANSFER RECORDING MATERIAL

This application is a Continuation-In-Part of application Ser. No. 235,521, filed on Aug. 24, 1988 now abandoned.

BACKGROUND OF THE INVENTION

The present invention relates to a thermosensitive image transfer recording material for multicolor or full color reproduction.

Conventionally, there is known a thermosensitive image transfer recording material as partially shown in FIG. 1, which comprises a ribbon-shaped substrate 1, a plurality of thermosensitive image transfer layer sections 3, for instance, of yellow, magenta, and cyan, optionally black colors, which are arranged side by side on the substrate 1 in the longitudinal direction thereof, with a sufficient space 1*a* between the thermosensitive image transfer layer sections 3 for allowing a relatively narrow marker layer section 2 extending in the direction of the entire width of the substrate 1 to be disposed therein, by which the color of each image transfer layer section 3 adjacent to the marker layer section 2 can be automatically optically detected, for instance, through the shape or width of the marker layer section 2. In this conventional thermosensitive image transfer recording material, comparatively large spaces 1*a* are left between the marker layer sections 2 and the image transfer layer sections 3 adjacent thereto, and therefore the surface of the substrate 1 in those spaces is not covered at all, but bare, so that the conventional thermosensitive image transfer recording material has the following shortcomings:

(1) Thermosensitive image transfer layer sections and the marker layer sections are partially or totally peeled off the substrate near or at the end portions thereof, so that improper image transfer and improper color detection take place. This is probably because when the ribbon-shaped thermosensitive image transfer recording is rolled, the substrate is stressed in a different direction from the direction of the stress laid on the thermosensitive image transfer layer sections and the marker layer sections formed on the substrate, so that the thermosensitive image transfer layer sections and the marker layer sections are apt to be peeled off the substrate from the ends of each layer section, at which the fixity of those layer sections is weak.

(2) The thermosensitive image transfer layer sections and the exposed portions of the substrate between the image transfer layer sections and the marker layer sections have different coefficients of friction. Therefore, when the recording material is transported, for example, by a transportation roller during recording, the roller may slip on the recording material due to the different coefficients of friction. The result is that the marker layer sections cannot be correctly detected and accordingly the positional control of the recording material cannot be correctly performed.

SUMMARY OF THE INVENTION

It is therefore an object of the present invention to provide a thermosensitive image transfer recording material for multicolor or full color reproduction, from which the shortcomings of the conventional thermosensitive image transfer recording materials are eliminated, such as the peeling of the marker layer sections and the thermosensitive image transfer layer sections off the substrate, and improper detection of the marker layer sections due to the slip of the transport roller on the recording material.

The above object of the present invention is attained by a thermosensitive image transfer recording material comprising a ribbon-shaped substrate, a plurality of thermosensitive image transfer layer sections having different colors formed on the substrate, which are sequentially disposed adjacent to each other in the longitudinal direction of the substrate, and a plurality of marker layer sections for mechanically and optically detecting the color of the thermosensitive image transfer layer sections adjacent to each marker layer section, which are disposed in the boundary regions between the thermosensitive image transfer layer sections extending across the entire width of the recording substrate in such a configuration that at least part of the surface of each marker section is covered by at least one of the two thermosensitive image transfer layer sections adjacent to the marker layer section, with the entire surface of the substrate being completely covered by the image transfer layer sections and the marker layer sections. As a matter of course, at least the portions of the thermosensitive image transfer layer sections which cover the marker layer sections do not hinder the optical detection of the marker layer sections under the thermosensitive image transfer sections.

DETAILED DESCRIPTION OF THE PREFERRED EMBODIMENTS

Figure 1:
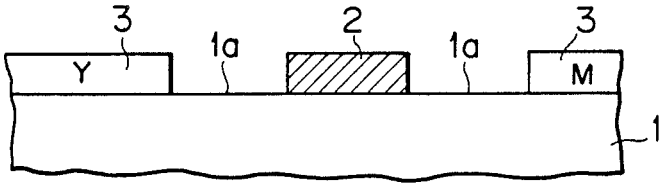
FIG. 1 PRIOR ART
FIG. 1 is a schematic partial cross-sectional view of a conventional thermosensitive image transfer recording material.

Referring now to the drawing, wherein like reference numerals designate identical or corresponding parts throughout the several views, and more particularly to FIG. 1, the present invention will now be explained in detail, which shows a schematic cross-sectional view of an embodiment of a thermosensitive image transfer recording material according to the present invention.

Figure 2:
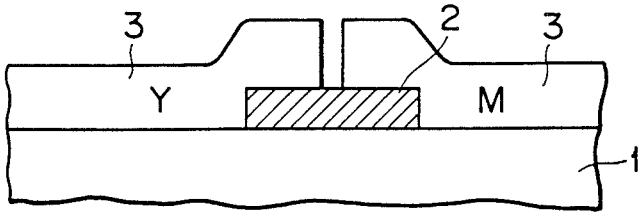
FIG. 2 is a schematic partial cross-sectional view of an embodiment of a thermosensitive image transfer recording material according to the present invention.

In FIG. 2, reference numeral 1 designates a substrate or a substrate with an undercoat layer (not shown). On the substrate 1, there are disposed a plurality of marker layer sections 2, for instance, of a black color, which preferably extend in the direction of the entire width of the thermosensitive image transfer recording material, and by which the color of each image transfer layer section 3, that is, yellow (Y), magenta (M), cyan (C), or black (Bk), not all of which is shown, can be optically detected. As shown in FIG. 1, both end portions of the marker layer section 2 are covered by two image transfer layer sections 3,3, that is, a yellow (Y) thermosensitive image transfer layer section and a magenta (M) thermosensitive image transfer layer section, which are disposed close to each other, with a small gap therebetween on the marker layer section 2, in which gap the marker layer section 2 is exposed.

The portions of the image transfer layers on each marker layer section 2 in the boundary regions between the image transfer sections 3 are not transferred onto a transfer sheet (not shown) during the recording process in the present invention.

Figure 3:
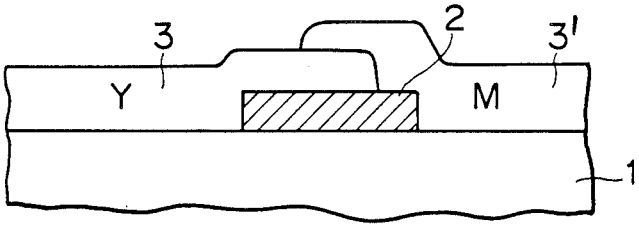
FIG. 3 is a schematic partial cross-sectional view of another embodiment of a thermosensitive image transfer recording material according to the present invention.

FIG. 3 is a schematic partial cross-sectional view of another embodiment of a thermosensitive image transfer recording material according to the present invention. In this embodiment, the marker layer section 2 extending across the entire width of the recording substrate is covered by the two image transfer layer sections 3, 3', one of which partly overlaps the other on the marker layer section 2, without any gap therebetween, so that no portion of the marker layer section 2 is exposed.

Figure 4:
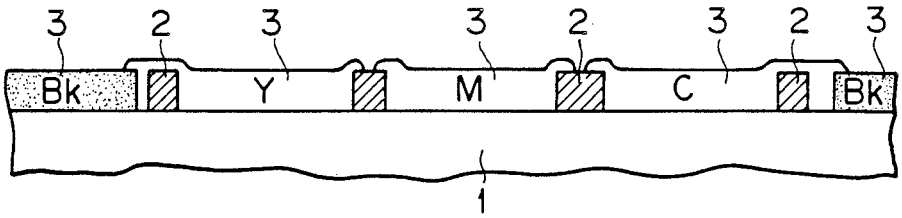
FIG. 4 is a schematic partial cross-sectional view of a further embodiment of a thermosensitive image transfer recording material according to the present invention.

FIG. 4 is a schematic partial cross-sectional view of a further embodiment of a thermosensitive image transfer recording material according to the present invention. This thermosensitive image transfer recording material comprises a yellow (Y) image transfer section, a magenta (M) image transfer section, a cyan (C) image transfer section, and a black (Bk) image transfer section, with a marker layer section 2 interposed between the image transfer sections, provided that the marker layer sections adjacent to the opposite ends of each black (Bk) image transfer section are covered so as to be crossed over by any of the other three colored image transfer layer sections sections, the marker layers extending across the entire width of the recording substrate.

In the present invention, as the substrate, plastic films and paper can be employed. More specifically, plastic films having relatively high heat resistance such as polyester, polycarbonate, triacetylcellulose, nylon, and polyimide films; cellophane; and parchment paper can be preferably employed.

It is preferable that the substrate be about 2 to 15 $\mu$m thick when a thermal head is employed for thermal transfer of the image transfer layer sections. However, when the image transfer layer sections to be transferred can be selectively heated, for instance, by using laser beams, there is no particular limitation to the thickness of the substrate.

When a thermal head is employed for thermal transfer of the image transfer layer sections, it is preferable that the substrate is backed with a heat resistant protective layer on the side of the substrate with which the thermal head comes into contact during the thermal transfer recording, that is, on the opposite side to the thermosensitive image transfer sections with respect to the substrate, for improvement of the heat resistance of the substrate. The materials available for the heat resistant protective layer are, for example, silicone resin, fluorine-contained resin, polyimide resin, epoxy resin, phenol resin, melamine resin, and nitrocellulose. For improvement of the heat resistance of the substrate, the use of the above-mentioned protective layer is in fact effective. Alternatively, for the same purpose, the substrate may be made from any heat resistant materials.

Furthermore, an undercoat layer may be provided on the substrate so as to be interposed between the substrate and the image transfer layer sections. As such an undercoat layer, the following layers can be provided for the following respective purposes:

(1) Adhesive layer for improvement of the adhesion of the image transfer layer sections to the substrate.
(2) Peel-off layer for facilitating the peeling of the image transfer layer sections off the substrate and the transfer of the image transfer layer sections to a transfer sheet.
(3) Matt layer for making the transferred images not shiny i.e. dull.

In the present invention, the image transfer layer sections are substantially optically transparent, and capable of producing colors such as yellow, magenta, cyan, and other colors by the superimposing thereof, and black color when necessary.

Binder agents use in the image transfer layer sections are, for example, natural waxes such as beeswax, hydrous lanolin, carnauba wax, candelilla wax, and montan wax; synthetic waxes such as paraffin wax, microcrystalline wax, oxidized waxes, ester waxes, and low-molecular-weight polyethylene; higher fatty acids such as lauric acid, myristic acid, palmitic acid, stearic acid, and behenic acid; higher alcohols such as stearyl alcohol, and behenyl alcohol; esters such as fatty acid esters of sucrose, and fatty acid esters of sorbitan; and fatty acid amides such as stearamide, and oleamide. When necessary, elastomers such as polyamide resin, polyester resin, epoxy resin, polyurethane resin, acrylic resin, polyethylene, polyethylene—acrylic copolymer resin, polyethylene—vinyl acetate copolymer resin, vinyl chloride resin, cellulose resins, polyvinyl alcohol resin, petroleum resin, phenol resin, styrene resin, natural rubber, styrene-butadiene rubber, isoprene rubber, and chloroprene rubber; and oils such as mineral oil and vegetable oils may be employed in combination with the above-mentioned binder agents.

The coloring agents available for use in the thermosensitive image transfer layer sections are conventionally employed pigments and dyes.

When the thermosensitive image transfer recording material according to the present invention is prepared, it is preferable that the thermosensitive image transfer layer sections and marker layer sections be printed on the substrate by photogravure or by flexography.

EXAMPLE

Yellow, magenta, cyan and black inks were prepared by mixing the respective components with the following formulations:

| | Parts by Weight |
|---|---|
| [Yellow Ink] | |
| (Coloring Agent) | 8.0 |
| Fast Yellow | |
| (Binder Components) | |
| Carnauba wax | 8.5 |
| Paraffin wax | 76.5 |
| Ethylene - vinyl acetate copolymer | 5.0 |
| Mineral oil | 2.0 |
| (Solvent) | 566.7 |
| Toluene | |
| [Magenta Ink] | |
| (Coloring Agent) | 13.0 |
| Carmine 6B | |
| (Binder Components) | |
| Carnauba wax | 8.0 |
| Paraffin wax | 72.0 |
| Ethylene - vinyl acetate copolymer | 5.0 |
| Mineral oil | 2.0 |
| (Solvent) | 566.7 |

-continued

| | Parts by Weight |
|---|---|
| Toluene | |
| [Cyan Ink] | |
| (Coloring Agent) | 15.0 |
| Copper phthalocyanine | |
| (Binder Components) | |
| Carnauba wax | 7.8 |
| Paraffin wax | 70.2 |
| Ethylene - vinyl acetate copolymer | 5.0 |
| Mineral oil | 2.0 |
| (Solvent) | 566.7 |
| Toluene | |
| [Black Ink] | |
| (Coloring Agent) | 20.0 |
| Carbon black | |
| (Binder Components) | |
| Carnauba wax | 7.3 |
| Paraffin wax | 65.7 |
| Ethylene - vinyl acetate copolymer | 5.0 |
| Mineral oil | 2.0 |
| (Solvent) | 566.7 |
| Toluene | |

In the above prepared black ink was used not only for a black layer section 3, but also for a marker layer section 2.

The above prepared inks were printed on a 3.5 μm thick polyethylene terephthalate (PET) film by photogravure as illustrated in FIG. 4, whereby a thermosensitive image transfer recording material according to the present invention was prepared. More specifically, the black (Bk) layer sections 3 and the marker layer sections 2 were first printed on the substrate 1 by using a black mask (not shown), and the black ink as mentioned above. Thereafter, a yellow (Y) image transfer section, a magenta (M) image transfer section, and a cyan (C) image transfer section were successively printed as illustrated in FIG. 3, by using the yellow ink, the magenta ink and the cyan ink, respectively The printing order of the three layers is not always limited to the above.

In the above embodiment, the image transfer layer sections may be provided so as to cover each marker layer 2 in such a manner as shown in FIG. 2 or as shown in FIG. 3, provided that the marker layer sections adjacent to the opposite ends of each black (Bk) image transfer section are covered so as to be crossed over by any of the other three colored image transfer layer sections Furthermore, the black (Bk) image transfer layer sections may be eliminated in the present invention.

What is claimed is:

1. A thermosensitive image transfer recording material comprising:

a ribbon-shaped substrate, a plurality of thermosensitive image transfer layer sections formed on said substrate, each thermosensitive image transfer layer section having a different color, which are sequentially disposed in the longitudinal direction of said substrate, and a plurality of marker layer sections for optically detecting the color of any of the thermosensitive image transfer layer sections adjacent to said marker layer section, each of which marker layer sections extends across the entire width of the recording substrate and is disposed in the boundary regions between said thermosensitive image transfer layer sections in such a configuration that at least part of the surface of each marker section is covered by at least one of the two thermosensitive image transfer layer sections adjacent to said marker layer section, with the entire surface of said substrate being completely covered by said image transfer layer sections and said marker layer sections.

2. The thermosensitive image transfer recording material as claimed in claim 1, wherein at least the portions of said thermosensitive image transfer layer sections which cover said marker layer sections have such an optical transparency that the optical detection of said marker layer sections under said thermosensitive image transfer sections is not hindered.

3. The thermosensitive image transfer recording material as claimed in claim 1, wherein each marker layer section of said marker layer sections is covered by both of the two thermosensitive image transfer layer sections adjacent thereto which thermosensitive image transfer layer sections are disposed close to each other, within a small gap therebetween on said marker layer section, for allowing said marker layer section to be optically detected for the detection of the color of any of said adjacent thermosensitive image transfer layer sections.

4. The thermosensitive image transfer recording material as claimed in claim 1, wherein each marker layer of said marker layer sections is covered by both of the two thermosensitive image transfer layer sections adjacent thereto in such a manner that one of said image transfer layer sections partly overlaps the other image transfer layer section on said marker section, without any gap therebetween.

5. The thermosensitive image transfer recording material as claimed in claim 4, wherein at least the portions of said thermosensitive image transfer layer sections which cover said marker layer sections have such an optical transparency that the optical detection of said marker layer sections under said thermosensitive image transfer sections is not hindered.

6. The thermosensitive image transfer recording material as claimed in claim 1, wherein said substrate comprising a plastic film.

7. The thermosensitive image transfer recording material as claimed in claim 6, wherein said plastic film is a heat resistant plastic film.

8. The thermosensitive image transfer recording material as claimed in claim 1, wherein said substrate comprising a sheet of paper.

9. The thermosensitive image transfer recording material as claimed in claim 1, wherein said substrate comprising parchment paper.

10. The thermosensitive image transfer recording material as claimed in claim 1, wherein said substrate is backed with a heat resistant protective layer which is disposed opposite to said thermosensitive image transfer layer sections on said substrate.

11. The thermosensitive image transfer recording material as claimed in claim 1, further comprising an undercoat layer between said substrate and said thermosensitive image transfer layer sections.

12. The thermosensitive image transfer recording material as claimed in claim 11, wherein said undercoat layer is an adhesive layer for improvement of the adhesion of said thermosensitive image transfer layer sections to said substrate.

13. The thermosensitive image transfer recording material as claimed in claim 11, wherein said undercoat layer is a peel-off layer for improvement of the peeling of said image transfer layer sections off said substrate.

14. The thermosensitive image transfer recording material as claimed in claim 11, wherein said undercoat layer is a matt layer for making dull the surface of said thermosensitive image transfer layer sections, when transferred.

15. The thermosensitive image transfer recording material as claimed in claim 1, wherein said color of each of said thermosensitive image transfer layer sections is selected from the group consisting of yellow, magenta, and cyan colors, which colors can be superimposed to produce further different colors.

16. The thermosensitive image transfer recording material as claimed in claim 1, wherein said color of each of said thermosensitive image transfer layer sections is selected from the group consisting of yellow, magenta, and cyan colors, which colors can be superimposed to produce further different colors, and black color.

17. The thermosensitive image transfer recording material as claimed in claim 1, wherein said thermosensitive image transfer layer sections and said marker layer sections are printed on said substrate by photogravure or by flexography.

* * * * *

UNITED STATES PATENT AND TRADEMARK OFFICE

CERTIFICATE OF CORRECTION

PATENT NO. : 4,983,444

DATED : JANUARY 8, 1991

INVENTOR(S) : YOUJI IDE ET AL

It is certified that error appears in the above-identified patent and that said Letters Patent is hereby corrected as shown below:

Column 3, line 33, delete "sections" (second occurrence).

Column 4, line 8, after "shiny", insert --,--;
line 14, delete "use", insert --used--.

Column 5, line 39, after "respectively", insert --.--;
line 48, after "sections", insert --.--.

Signed and Sealed this

Twentieth Day of July, 1993

*Attest:*

Michael K. Kirk

MICHAEL K. KIRK

*Attesting Officer*

*Acting Commissioner of Patents and Trademarks*